US011396867B2

(12) United States Patent
Minelle

(10) Patent No.: US 11,396,867 B2
(45) Date of Patent: Jul. 26, 2022

(54) DC VOLTAGE AIR CONDITIONING COMPRESSOR DRIVE UNIT

(71) Applicant: RENCOOL PTY LTD, Brisbane (AU)

(72) Inventor: Stephen Minelle, Archerfield (AU)

( * ) Notice: Subject to any disclaimer, the term of this patent is extended or adjusted under 35 U.S.C. 154(b) by 6 days.

(21) Appl. No.: 16/760,854

(22) PCT Filed: Nov. 29, 2018

(86) PCT No.: PCT/AU2018/051273

§ 371 (c)(1),
(2) Date: Apr. 30, 2020

(87) PCT Pub. No.: WO2019/104386

PCT Pub. Date: Jun. 6, 2019

(65) Prior Publication Data

US 2021/0215142 A1 Jul. 15, 2021

(30) Foreign Application Priority Data

Dec. 1, 2017 (AU) ..... 2017904862

(51) Int. Cl.

| | |
|---|---|
| ***F04B 35/04*** | (2006.01) |
| ***F04B 39/06*** | (2006.01) |
| ***F04B 53/08*** | (2006.01) |
| ***F04B 39/12*** | (2006.01) |
| *F04B 49/06* | (2006.01) |

(52) U.S. Cl.

CPC ..... *F04B 35/04* (2013.01); *F04B 39/06* (2013.01); *F04B 39/121* (2013.01); *F04B 53/08* (2013.01); *F04B 49/065* (2013.01); *F04B 2203/0401* (2013.01); *F04B 2203/0402* (2013.01)

(58) Field of Classification Search

USPC ..... 417/359, 360

See application file for complete search history.

(56) References Cited

U.S. PATENT DOCUMENTS

| | | | |
|---|---|---|---|
| 1,622,876 A | 3/1927 | Leo | |
| 2,369,841 A | 2/1945 | Neeson | |
| 6,364,632 B1 | 4/2002 | Cromm et al. | |
| 6,398,521 B1 * | 6/2002 | Yorulmazoglu | F04D 13/021 403/298 |

(Continued)

FOREIGN PATENT DOCUMENTS

| | | | |
|---|---|---|---|
| AU | WO2019/104386 A1 | 6/2019 | |
| CN | 105508196 A | 4/2016 | |

*Primary Examiner* — Charles G Freay

(74) *Attorney, Agent, or Firm* — FisherBroyles, LLP; Jill A. Jacobson

(57) ABSTRACT

The invention relates to a Direct Current (DC) air conditioning compressor drive unit for use in both buildings and in vehicle installations. Energy savings can be demonstrated in the automotive industry when compared to the current status of known DC air conditioning drive units and in particular those relying on direct or pulley drive. More particularly, when coupled to DC battery and inverter technology for air conditioning purposes within domestic housing, commercial and industrial buildings, it can provide extreme energy savings. Preferably, the purpose of this innovation is to enhance the viability and energy savings opportunities of using DC power in air conditioning if used in conjunction with smart compressor technology.

15 Claims, 12 Drawing Sheets

(56) References Cited

U.S. PATENT DOCUMENTS

| | | | | |
|---|---|---|---|---|
| 2006/0024174 | A1* | 2/2006 | Welch | F04D 1/063 417/360 |
| 2008/0019850 | A1* | 1/2008 | Tajima | H02K 5/12 417/410.1 |
| 2016/0209097 | A1* | 7/2016 | Choueifati | F25B 49/025 |
| 2017/0114837 | A1* | 4/2017 | Yamaguchi | F16D 3/74 |
| 2018/0076681 | A1* | 3/2018 | Iketaka | H02K 5/04 |

* cited by examiner

DC VOLTAGE AIR CONDITIONING COMPRESSOR DRIVE UNIT

CROSS-REFERENCE TO RELATED APPLICATIONS

This application is a U.S. national stage application under 35 U.S.C. § 371 of PCT/AU2018/051273, filed on Nov. 29, 2018, and published as WO2019/104386 A1 on Jun. 6, 2019, which claims priority to Australian application no. 2017904862, filed on Dec. 1, 2017.

FIELD OF INVENTION

The invention relates to a Direct Current (DC) air conditioning compressor drive unit for use in both buildings and in vehicle installations. Energy savings can be demonstrated in the automotive industry when compared to the current status of known DC air conditioning drive units and in particular those relying on direct or pulley drive. More particularly, when coupled to DC battery and inverter technology for air conditioning purposes within domestic housing, commercial and industrial buildings, it can provide extreme energy savings. Preferably, the purpose of this innovation is to enhance the viability and energy savings opportunities of using DC power in air conditioning if used in conjunction with smart compressor technology.

BACKGROUND TO THE INVENTION

Air conditioner technology has been recognised for over 100 years. During this time the principle of evaporative cooling using wind chill over a wet surface or over ice has progressed into refrigerated cooling that involves a power source to drive internal electronic parts. This has come about through the advent of a suitable refrigerant gas that when compressed could cool a surface and replace wind over a wet surface as a medium for air conditioning. The progress made in this field dictated the need for internal machinery parts for air conditioners, amongst which was the need for a compressor if the air conditioner was to be effective. This need also applied to the Refrigeration Industry where compressor technology was developed for cool room, refrigeration and deep freezer units. The common power source worldwide had been the acceptance of Alternating Current (AC) and parts for the new industry surrounding compressors was developed on this principle. AC power involves electricity generated from thermal or nuclear stations. Its popularity in recent years has waned due in some cases to blame for global warming and the dangers of radiation in the event of accidents. In the last two decades much work has been done to revisit an alternative power source known as Direct Current (DC). This is a well-known and reliable form of renewable energy that can be generated naturally through harvesting both the wind and the sun with smart technology, thereby eliminating the power source objections. DC powered compressors have been in use for some time in all types motor vehicles to provide air conditioning but they have traditionally required a motor to drive them, and in most cases, this would be a pulley driven unit that could only operate the air conditioning if the motor was running. The electrical circuit and power source is likely to come from either a 12 or 24 volt on board battery. The use of DC air conditioning in domestic housing, commercial buildings and Industrial complexes has been limited because there is no motor to drive the compressor to circulate the refrigerant gas or drive the blowers. Recent developments in battery technology have allowed for harvested DC power to be stored in smart batteries. It follows that an innovative compressor would be required to take advantage of this power source, but it must be able to operate reliably without pulley drive. The compressor generally uses more power than any other part of an air conditioning unit and is integral to an efficient system.

The invention addresses that opportunity by developing a unique and novel method of constructing a DC compressor that limits power input whilst providing an output equal to AC compressor technology, and in some instances surpassing it in some features of its construction and performance as we know it to be at this time.

Air conditioners rely on a drive unit to operate the refrigeration cycle. Drive units comprise a compressor and a motor. The motor drives the compressor. In both light automotive and heavy duty machinery and other equipment it has been usual for the compressor to be pulley or direct drive units powered by the motor. Direct Current (DC) has always been the power source and provided by on board batteries in various voltages. This arrangement allows for air conditioners to be installed in a variety of locations, such as: light and heavy mobile equipment or machinery, telecommunication shelters, cars, trucks, motor homes, military equipment. Homes, commercial structures, industrial type buildings and other environments have been limited in the past from DC energy by preference for Alternating Current (AC) provided from a central power grid. The relatively recent availability of solar and wind power devices capable of generating DC power has not been exploited to any extent in the domestic, commercial and industrial air conditioning field. Furthermore, the availability of a suitable compressor in DC form that limits energy input whilst providing adequate performance has not been freely available for domestic or commercial premises. DC air conditioner compressor drive units are generally connected to battery, alternator, solar or wind power via a controller in automotive, domestic, commercial and industrial applications. In the case of automotive installations, the compressor drive units are required to be compact. The advent of DC powered air conditioning for homes, commercial and industrial does not necessarily place such a limitation on space.

SUMMARY OF THE INVENTION

The present Rencool invention provides for a Primary and an Anti Idle and No Pulley drive compressor designed for both small and large equipment use in the air conditioning of vehicles, domestic housing, commercial and industrial buildings.

Anti Idle function can best be described as being able to maintain the cool effects of air conditioning within an operators vehicle interior space without having to keep the main engine operating. This is a huge energy savings benefit to large organisations running machinery and which converts into many litres of fuel in savings.

Primary function relates to machinery that does not have a Pulley Drive compressor as an option and deemed impossible for installation of air conditioning. With the Rencool DC compressor innovation this is still an option to install air conditioning. Testing is done with alternator capacity, allowable current consumption and the size of the DC compressor. This changes per machine and application configuration setup.

The Rencool concept is to use the DC voltage compressor technology instead of the conventional pulley belt drive compressor running from the engine pulley drive. The concept is able to be extended into all areas of air conditioning by applying the different variations and displacements of the compressor volume and speed and also the air conditioner system either rooftop or split type configuration but not limited to either. The compressor testing is done with piston and scroll type configurations and current consumption is married with the HVAC systems performance and allowable current consumption. All units have different cooling capacities and these must match the compressor displacement/output. The compressor capacity range is from 18 cc upwards without limitations and any model can be suited for different ranges of units with matching performance.

Current consumption, efficiency and performance are important criteria for testing the full range of DC voltage compressors for allowable current usage. All systems demand more or less power to cool. This must be tuned for the application of the unit for the best cooling capacity with the necessary power requirement. All testing extends to cabling and different brushless direct current (BLDC) controllers, encoders and programming of the software for the BLDC. The testing for the innovation extends to many types of controllers with different controller ampere (amp) capacities. This tends to provide a more efficient air conditioning system running from DC voltage input.

DISCLOSURE OF THE INVENTION

In one form, although it need not be the only or indeed the broadest form, the invention resides in a DC air conditioning compressor drive unit including:

a DC electric motor having a drive shaft— a compressor having a driven shaft— an adaptor which mounts the compressor relative to the electric motor to align the drive shaft of the electric motor and the driven shaft of the compressor- and a coupling connecting the drive shaft of the motor to the drive shaft of the compressor.

The Heat Sink Connection Housing (Adaptor) preferably aligns the drive shaft and the driven shaft substantially co-axially.

The DC air conditioning compressor drive unit preferably includes a programmable controller for controlling the supply voltage, current, speed, torque and other variations to the electric motor.

The DC air conditioning compressor drive unit preferably includes two retaining brackets for mounting the compressor to the Heat Sink Connection Housing (Adaptor)

The DC electric motor is preferably a brushless DC electric motor.

The compressor is preferably a piston type configuration but not restricted to piston only.

The DC air conditioning compressor drive unit is preferably configured so that the electric motor drives the compressor at a speed from and between 1 rpm to 3000 rpm.

The DC air conditioning compressor drive unit preferably includes and encoder so the efficiency of the DC electric motor can be tuned increasing the set point efficiency.

The DC air conditioning compressor drive unit preferably includes a (3) point terminal head enclosure located on top of the DC electric motor.

The DC air conditioning compressor drive unit preferably is sealed from water and dust and carries an IP rating of (56).

The compressor preferably has a capacity of and between 45 cc to 120 cc but not restricted to certain displacement.

The coupling preferably includes two aligned passages which are each open to a different opposite end of the coupling and which are dimensioned to receive the drive shaft of the electric motor and the driven shaft of the compressor, respectively.

The coupling preferably includes an elastomeric component between the passages.

The Heat Sink Connection Housing (Adaptor) preferably includes a cylindrical body having a cavity into which the drive shaft of the electric motor and the driven shaft of the compressor project and in which the coupling is located.

The Heat Sink Connection Housing (Adaptor) preferably includes a flange having bolt holes for bolting the (Adaptor) to the electric motor.

The Heat Sink Connection Housing (HSCH) preferably includes a heat-sink attached to the outer diameter of the alloy main assembly.

The Heat Sink Connection Housing (Adaptor) preferably has the heat-sink attached via use of bolts and a heat-sink pad cloth between the heat-sink and alloy main assembly.

The invention extends to the Heat Sink Connection Housing (Adaptor) as defined and described hereinabove.

The invention extends also to a mounting system comprising the (HSCH) and the retaining brackets.

The mounting system preferably includes fasteners for: fixing the retaining brackets to the compressor, fixing the retaining brackets to the (Adaptor) and for fixing the (Adaptor) to the electric motor.

BRIEF DESCRIPTION OF THE DRAWINGS

To assist in understanding the invention and to enable a person skilled in the art to put the invention into practical effect, preferred embodiments of the invention will be described by way of example only with reference to the accompanying drawings, wherein.

DETAILED DESCRIPTION OF THE INVENTION

Figure 1:
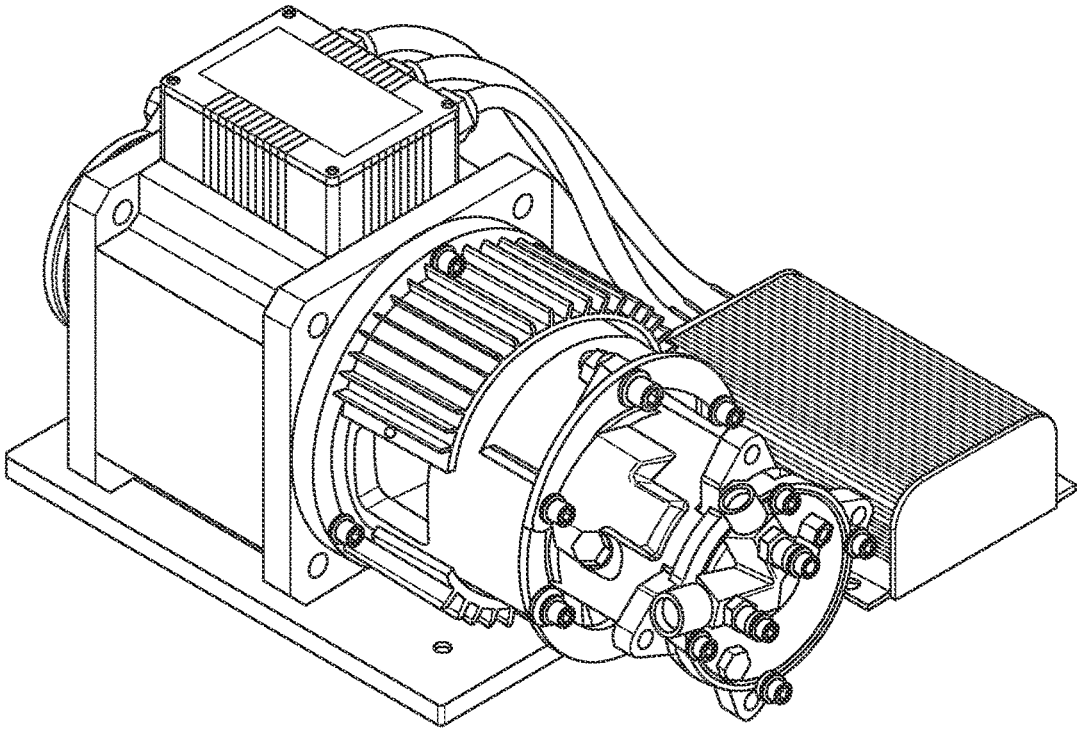
FIG. 1 shows a first perspective view of the DC air conditioning compressor drive unit in accordance with one embodiment of the invention.
Figure 2:
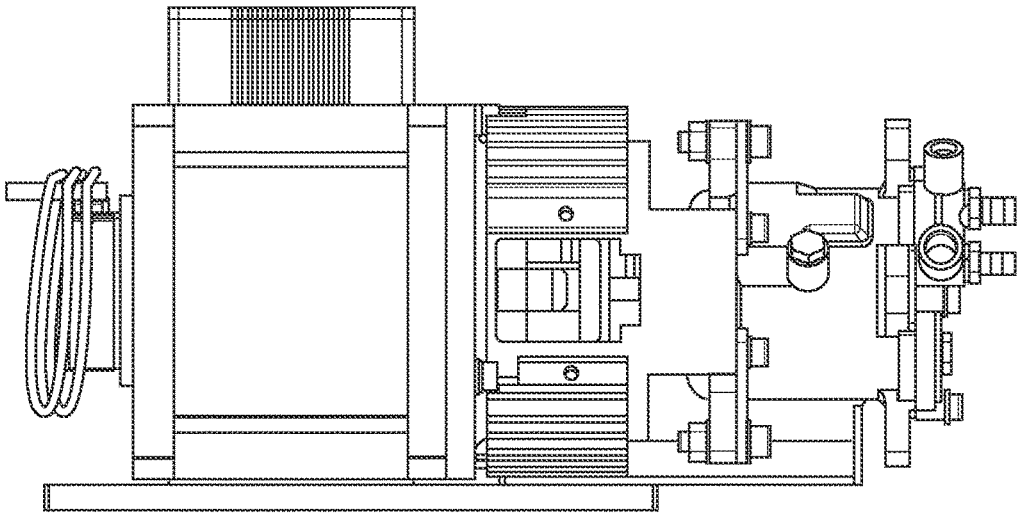
FIG. 2 shows a first side view of the DC air conditioning compressor drive unit in accordance with one embodiment of the invention.
Figure 3:
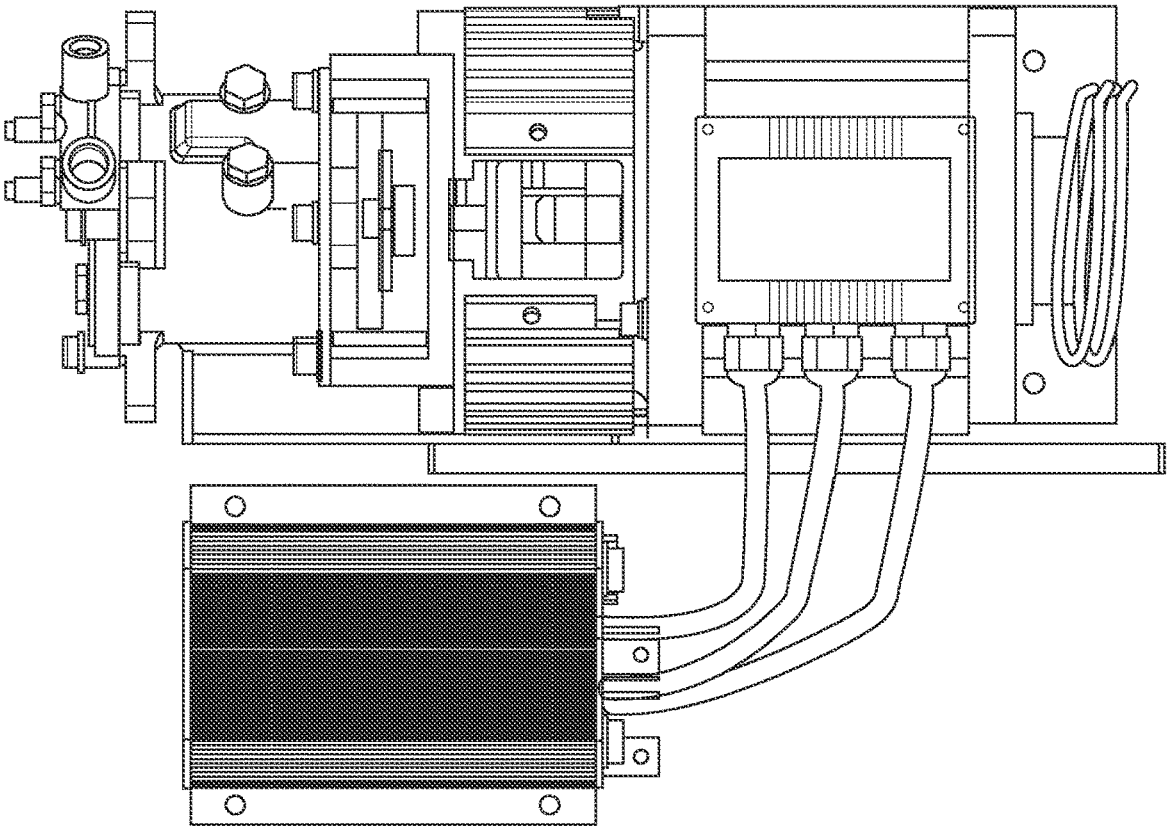
FIG. 3 shows a top view of the DC air conditioning compressor drive unit in accordance with one embodiment of the invention.
Figure 4:
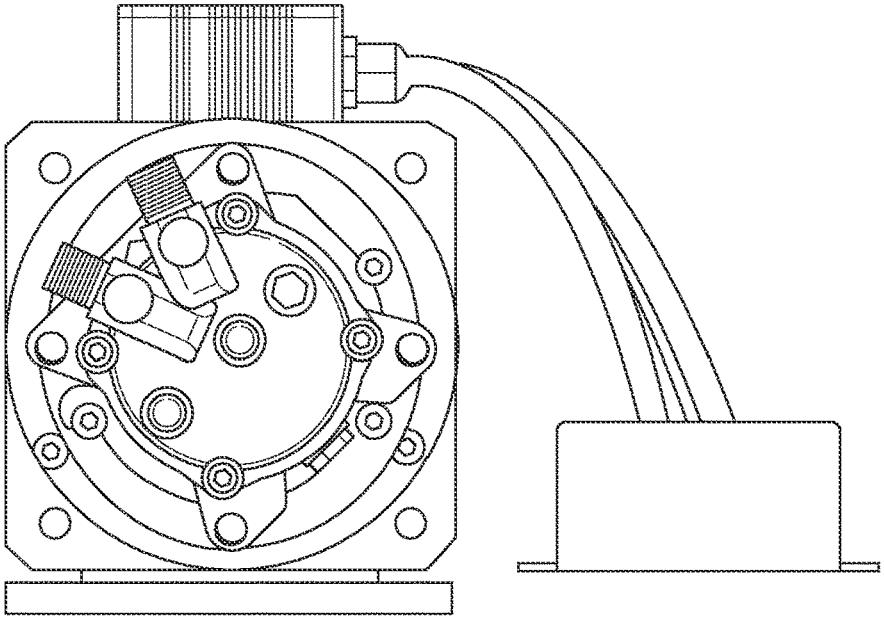
FIG. 4 shows an end view of the DC air conditioning compressor drive unit in accordance with one embodiment of the invention.
Figure 5:
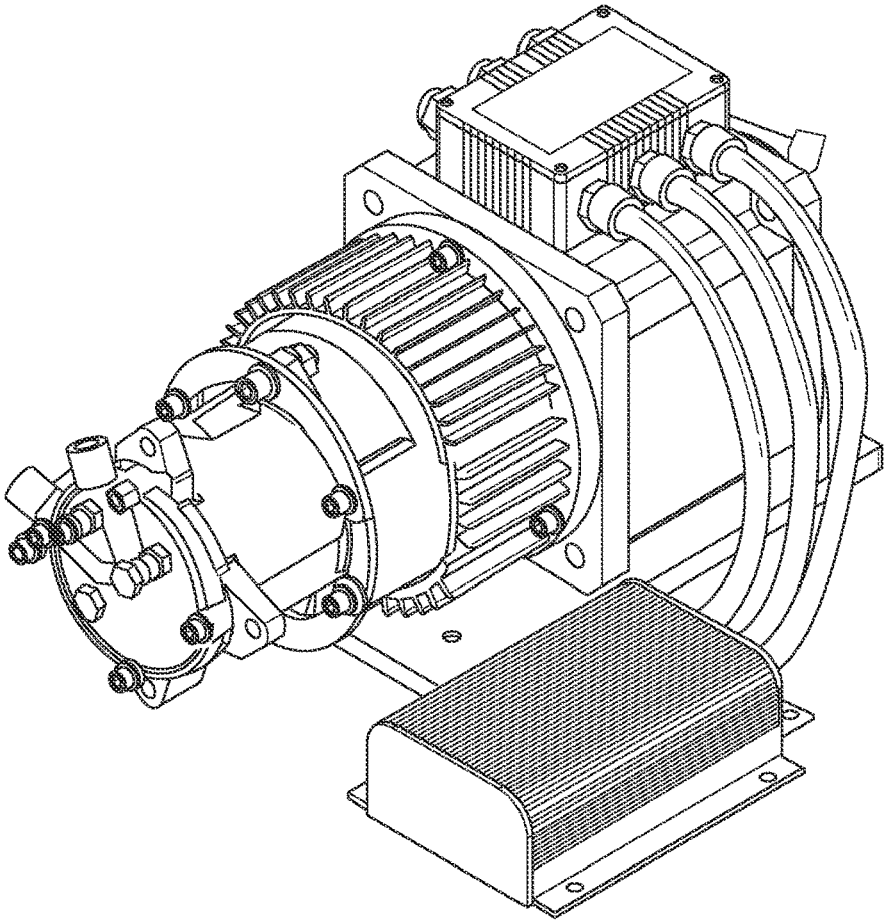
FIG. 5 shows a second perspective view of the DC air conditioning compressor drive unit in accordance with one embodiment of the invention.
Figure 6:
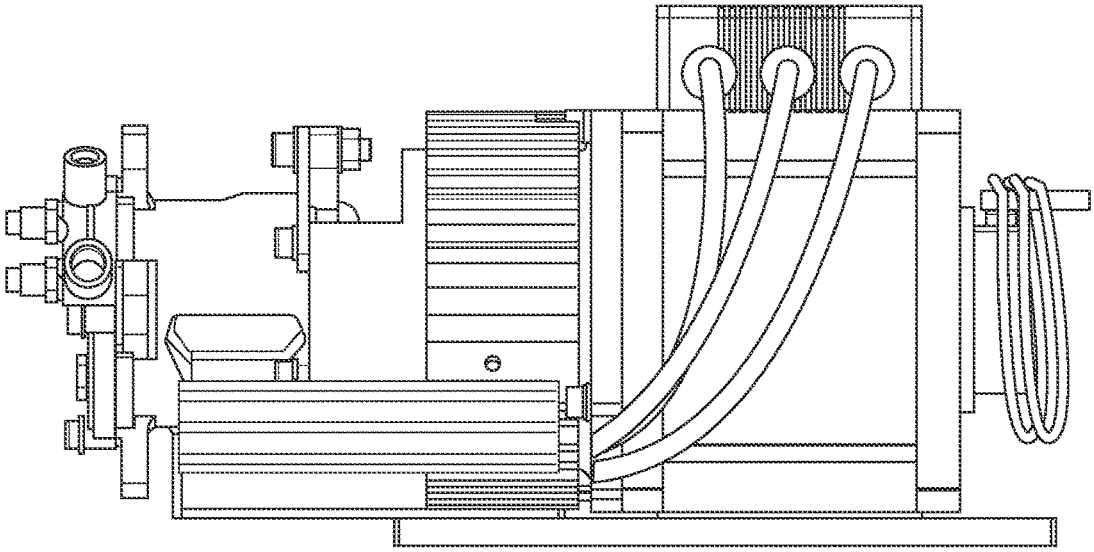
FIG. 6 shows a second side view of the DC air conditioning compressor drive unit in accordance with one embodiment of the invention.
Figure 7:
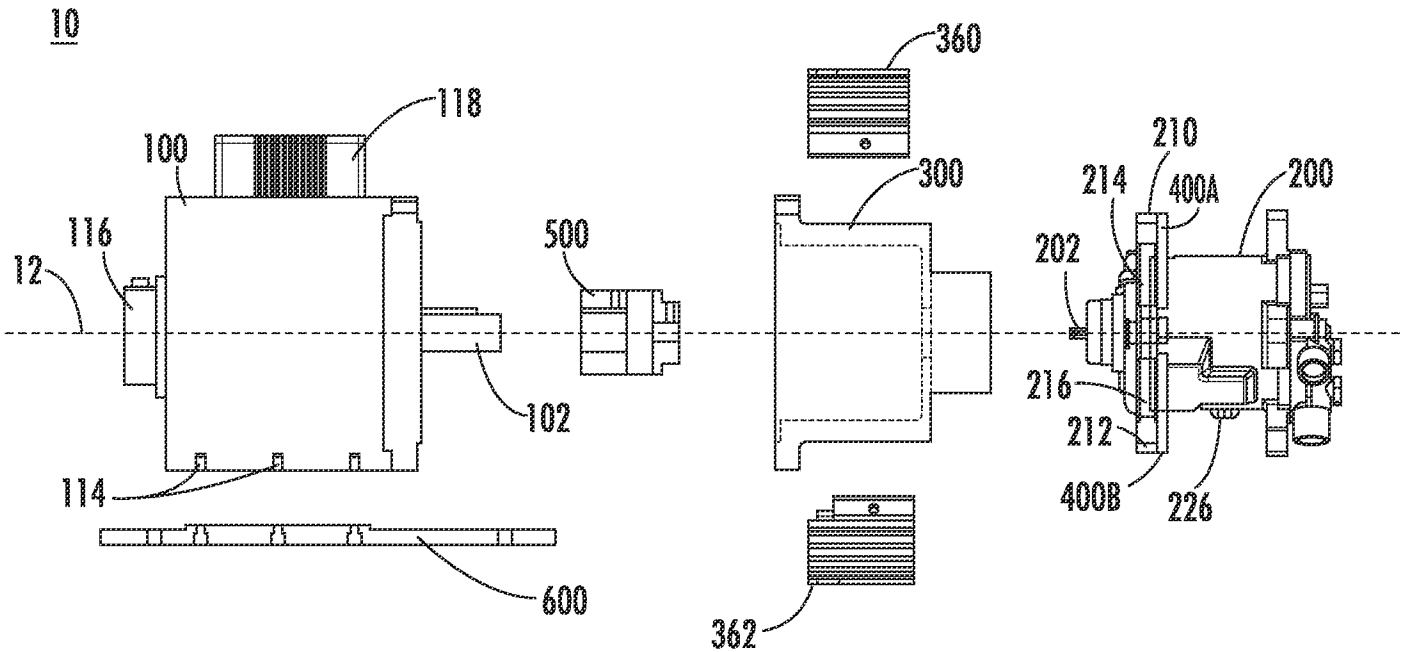
FIG. 7 shows a diagrammatic exploded side view of the DC air conditioning compressor drive unit in accordance with one embodiment of the invention.

In this patent specification, adjectives such as first and second, left and right, top and bottom, etc, are used solely to define one element or method step from another element or method step without necessarily required a specific relative position or sequence that is described by the adjectives. Words such as "comprises" or "includes" are not used to define an exclusive set of elements or method steps included in a particular embodiment of the present invention. In the drawings, like reference numbers refer to example parts.

The invention relates to a Direct Current (DC) air conditioning compressor drive unit for use in both buildings and in vehicle installations but without limitation to other applications. Preferably the unit according to the present invention is one configuration comprising a motor and a compressor. The unit's design allows for more versatility and enables the manipulation of power. Energy savings can be demonstrated in the automotive industry when compared to the current status of known DC air conditioning drive units and in particular those relying on indirect or pulley drive. More particularly, when coupled to DC battery and inverter technology for air conditioning purposes within domestic housing, commercial and industrial buildings, it can provide extreme energy savings. This is achieved by understanding that DC HVAC heat and load=energy used. By lowering the heat from the condenser as much as possible without compromising the cooling performance to lower torque we achieve lower power consumption. Should the head pressure be too low or too high then the systems cooling performance will drop so it is necessary to find a balance between the two. This is done by determining the systems configuration, air flow and resistance with the type of refrigerant used. All care is taken to marry up the electric motor and compressor with minimal heat loss in the entire assembly through good design. Preferably, the purpose of this innovation is to enhance the viability and energy savings opportunities of using DC power in air conditioning if used in conjunction with smart compressor technology.

FIGS. 1-8 show a DC air conditioning compressor drive unit 10 in accordance with one embodiment of the invention. The unit 10 comprises a brushless DC electric motor 100, a piston compressor 200, a heat sink connection housing (Adaptor) 300, a two-part retaining brackets 400A & 400B, a coupling 500, a base plate 600.

Figure 8:
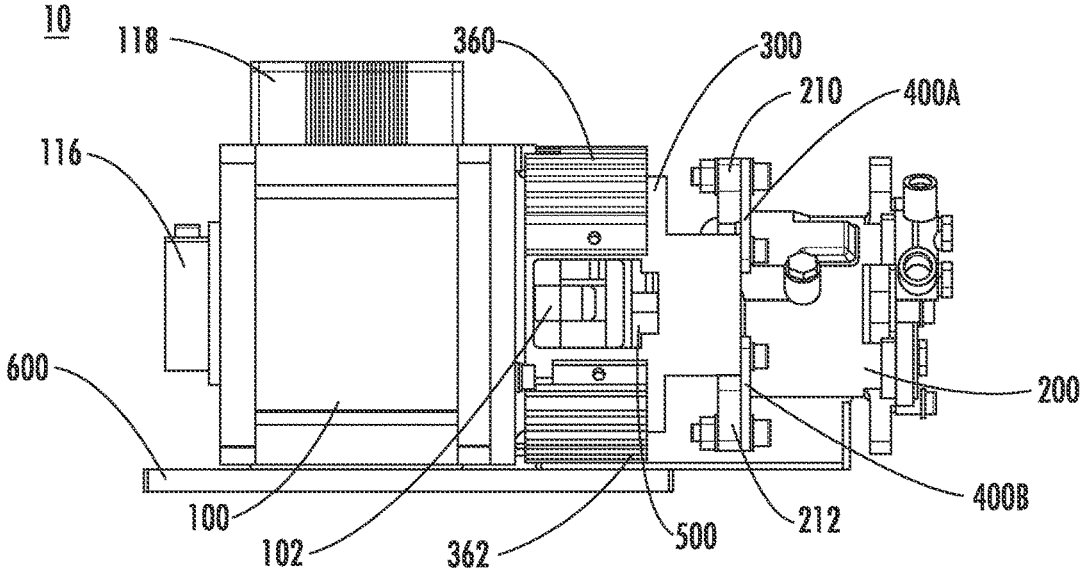
FIG. 8 shows a diagrammatic assembled view of the DC air conditioning compressor drive unit of FIG. 1.

FIGS. 1-7 show the unit 10 in an exploded condition and FIG. 8 shows the unit 10A (of FIGS. 28-29) in an assembled condition. The unit 10 is adapted to drive an air conditioning system of about 8 kilowatt cooling power. By suitable selection of the electric motor 100 and compressor 200 the unit 10 may be adapted to drive an air conditioner system of between 1 and 12 kilowatt cooling power.

Figure 9:
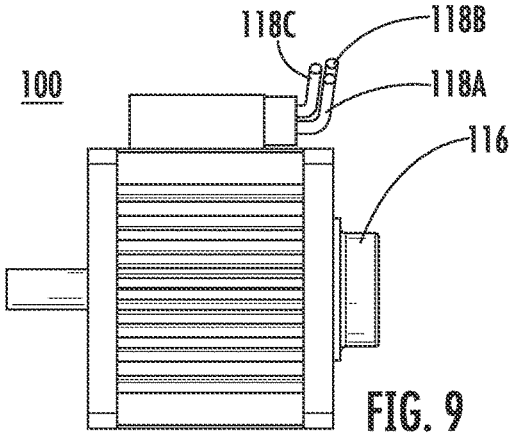
FIG. 9 is a diagrammatic perspective view of an electric motor (Encoder) cap of the DC air conditioning compressor drive unit of FIGS. 1-7.
Figure 10:
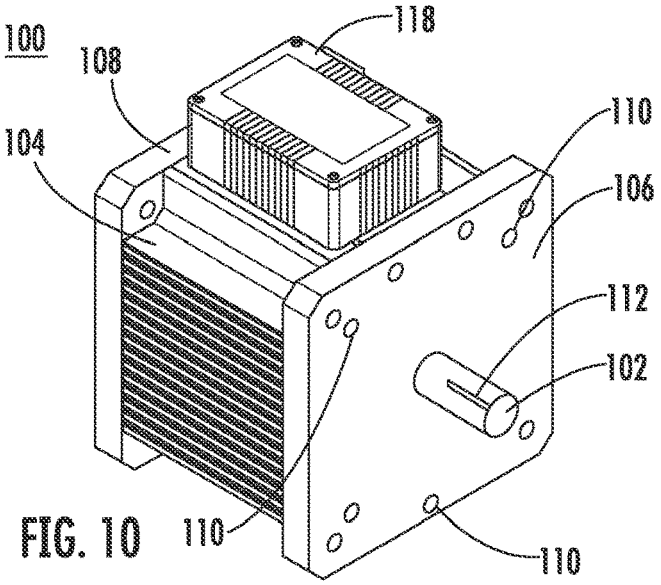
FIG. 10 is a diagrammatic perspective view of an electric motor of the DC air conditioning compressor drive unit of FIGS. 1-7.

FIGS. 9-10 show the electric motor 100 in more detail. The electric motor 100 has a vaned housing 104. The housing 104 includes vanes to promote heat dissipation from the electric motor 100. The electric motor 100 includes a face plate 106 and a back plate 108. The face plate 106 has three threaded holes 110 therein. The heat sink connection housing (Adaptor) 300 bolts to the front face plate 106 with bolts which are screw-thread received in the threaded holes 110. The electric motor 100 has a drive shaft 102. The drive shaft 102 extends through the face plate 106.

FIG. 10 shows the electric motor 100 includes a terminal block 118. The terminal block 118 has three (3) 8 mm studs enclosed in the terminal block 118. The three (3) 8 mm studs have three (3) 6 mm wires attached leading to the internal of electric motor 100. The terminal block 118 has four (4) mounting studs attached to the electric motor 100. The mounting studs are thread into the electric motor 100 housing on the base 104 of the electric motor 100.

The drive shaft 102 is generally cylindrical and includes a key 112. The electric motor 100 has an Encoder with cap cover 116 with (4) bolts mounted to the back plate 108.

The electric motor 100 is bolted to the base plate 600 by way of threaded holes 114 (shown in FIG. 7) in the underside of the housing 104.

The unit 10 uses a brushless DC electric (BLDC) motor as brushless DC motors typically suffer less friction losses than other types of DC motors such as brushed DC motors. The less the friction losses, the more energy efficient the electric motor 100 is. The electric motor 100 has permanent magnets bonded to its rotor and thus does not use electric energy to establish a magnetic field in the motor 100. The electric motor 100 is selected to operate on an input voltage of nominally either 12V, 24V, 48V, 74V. The electric motor 100 is specifically selected for the voltage of the electric system the unit 10 is to be connected to. A 12 volt electric motor 100 is selected for a 12 volt electric system such as used in a car, a 24V electric system is selected for a 24V electric system such as used in a mining machine. Similarly, 48V and 72 v electric motors 100 are selected for the electric systems of different environments. The electric motor 100 is a 1500 watt & 2000 watt rated motor at set speeds from 1700 to 3000 rpm, but not limited to 3000 rpm.

Figure 11:
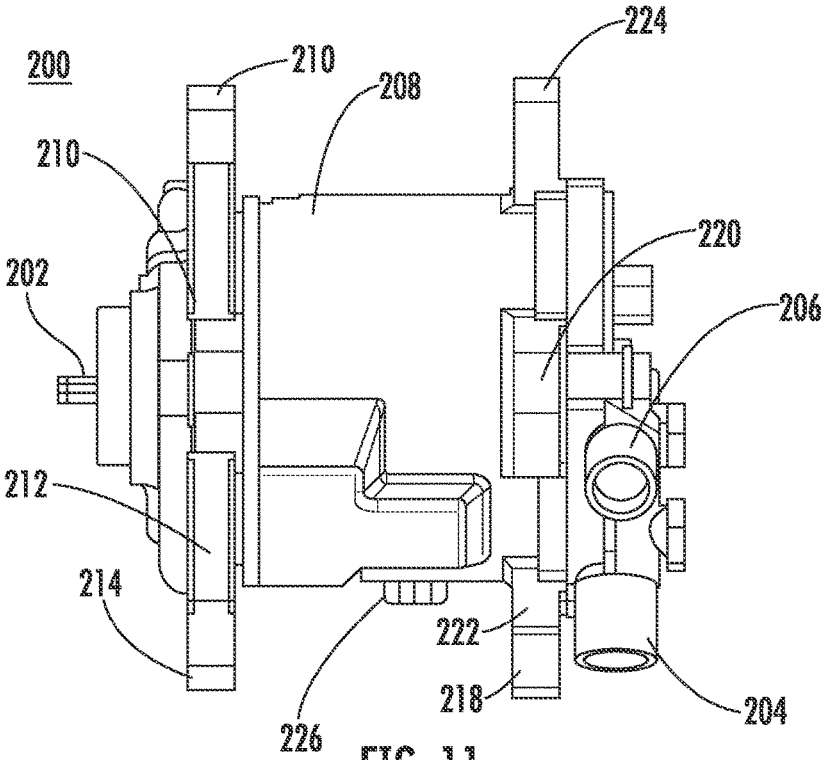
FIG. 11 is a diagrammatic side view of a compressor of the DC air conditioning compressor drive unit of FIGS. 1-7.
Figure 12:
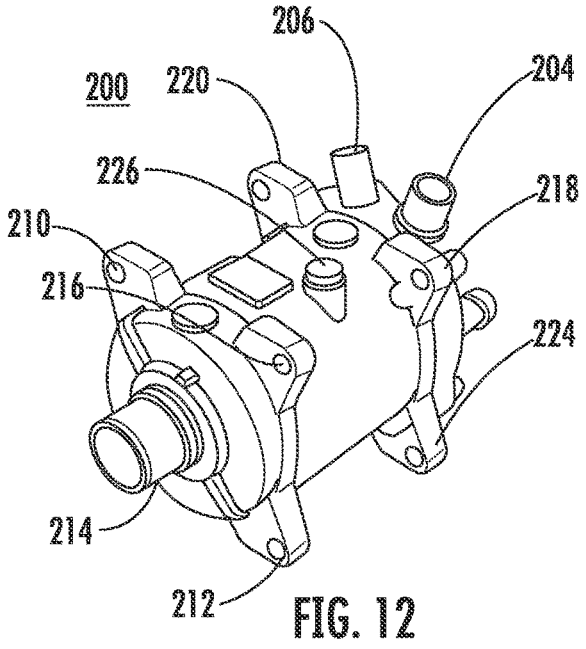
FIG. 12 is a perspective view of a compressor of the DC air conditioning compressor drive unit of FIGS. 1-7.
Figure 13:
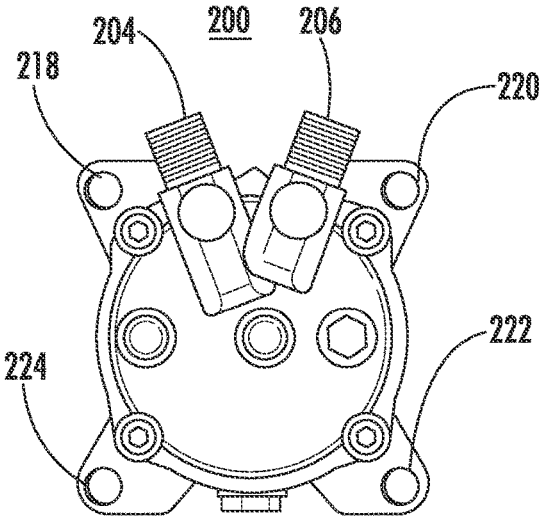
FIG. 13 is a diagrammatic end view of a compressor of the DC air conditioning compressor drive unit of FIGS. 1-7.
Figure 14:
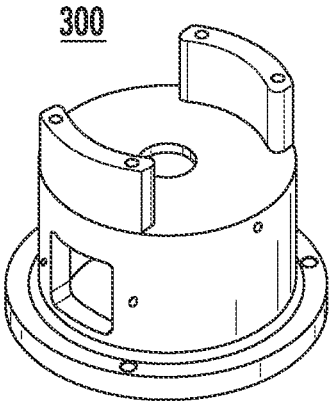
FIG. 14 is a perspective view of a heat sink connection housing (Adaptor) of the DC air conditioning compressor drive unit of FIGS. 1-7.
Figure 15:
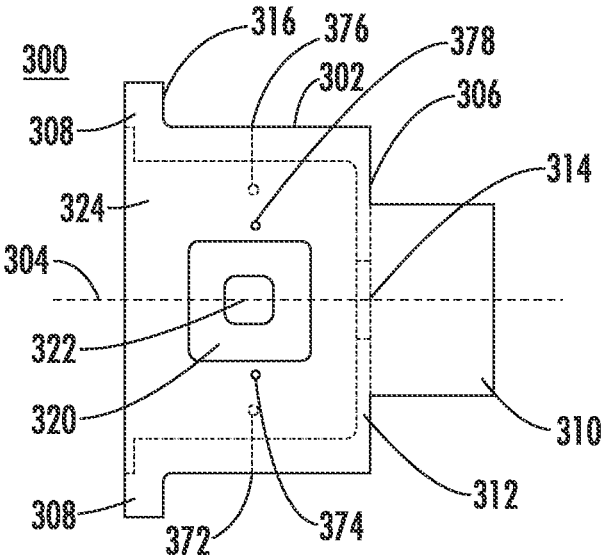
FIG. 15 is a diagrammatic side view of a heat sink connection housing (Adaptor) of the DC air conditioning compressor drive unit of FIGS. 1-7.
Figure 16:
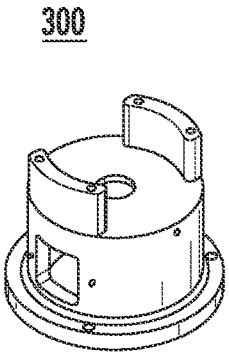
FIG. 16 is perspective view of a heat sink connection housing (Adaptor) of the DC air conditioning compressor drive unit of FIGS. 1-7.
Figure 17:
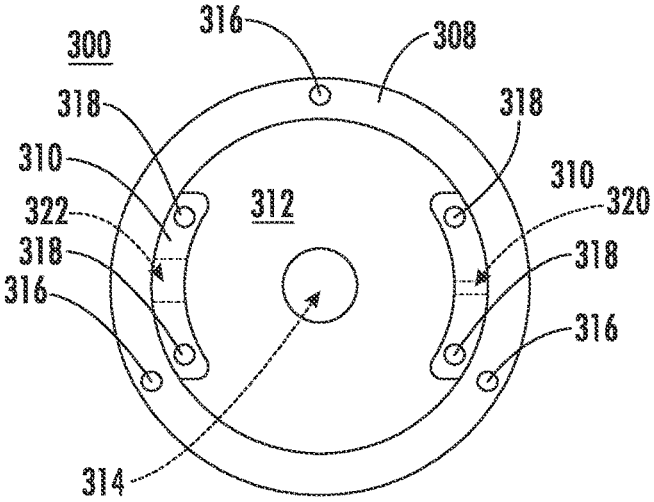
FIG. 17 is a diagrammatic end view of a heat sink connection housing (Adaptor) of the DC air conditioning compressor drive unit of FIGS. 1-7.

Referring to FIGS. 11-13, the compressor 200 has a driven shaft 202 through which the compressor is driven. The compressor 200 also has a suction port 204 and a discharge line port 206. The compressor 200 raises the pressure of the refrigerant which flows from the suction line port 204 to the discharge line port 206 when driven. When installed in an air conditioning system, the compressor 200 is connected between the evaporator and condenser of an air conditioning system to drive the air conditioning system. A suction line of the air conditioning system connects the compressor 200 to the evaporator via the suction line port 204. A discharge line of the air conditioning system connects the compressor 200 to the condenser via the discharge line port 206. The cylindrical housing 208 has an oil access thread sealed port 226. The sealed port access 226 is also used for oil return separation connection. The compressor 200 has a generally cylindrical housing 208 with two and four front mounting lugs 210, 212, 214 and 216. The compressor 200 has a generally cylindrical housing 208 with two and four rear mounting lugs 218, 220, 222 and 224. The mounting lugs 210, 212, 214 and 216 have threaded holes formed therein for bolting the retaining brackets 400A & 400B to the compressor 200.

The compressor 200 has volume displacement in 45 cc, 92 cc, 120 cc and 150 cc, but not restricted to 150 cc. The compressor has five (5) pistons for 45 cc and ten (10) pistons for 92 cc, 120 cc and 150 cc. The unit 10 is configured so that the electric motor 100 drives the compressor 200 at a speed of between 1000 rpm and 3000 rpm and more preferably at about 2000 rpm during normal operation. The application has found that the use of a piston compressor instead of the more often used scroll-type compressor is more efficient at these speeds.

FIGS. 14-17 depict the adaptor 300. The adaptor 300 includes a cylindrical body 302 having an open end 304 and a closed end 306. The closed end 304 of the body 302 is closed off by an end plate 312. A central hole 314 is formed in the end plate 312, through which the driven shaft 202 of the compressor 200 extends as shown in FIG. 8.

The adaptor 300 further includes a flange 308 about the open end 304 of the body 302. The flange 308 has three equi-spaced holes 316 therein, in which bolts are received for bolting the adaptor 300 to the electric motor 100. The holes 316 are complementary to the threaded holes 110 in the face plate 106 of the electric motor 100.

Two mount formations 310 project from the end plate 312 at the closed end 306 of the body 302. The mount formations 310 are semi-circular walls each having two threaded holes 318 at their distal ends. The retaining brackets 400A & 400B bolts to the mount formations 310 to mount the compressor 200 to the adaptor 300.

The body 302 of the adaptor 300 has a cavity 324. In the assembled condition of the unit 10, the drive shaft 102 of the electric motor 100 and the driven shaft 202 of the compressor 200 project into the cavity 324 and the coupling 500 is located in the cavity 324. The body 302 has two windows 320, 322 opposite each other in a cylindrical wall of the body 302. The window 320 is larger than the window 322. The cavity 324 is accessible by tools via the window 320 to connect and disconnect the coupling 500. The windows 320, 322 also inhibit resonance of the body 302.

Figure 18:
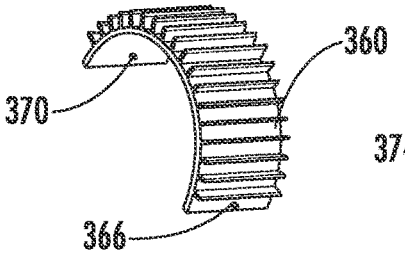
FIGS. 18-20 are diagrammatic views of a (upper and lower) two-part heat-sink attached to the heat sink connection housing (Adaptor) of the DC air conditioning compressor drive unit of FIGS. 1-7.
Figure 19:
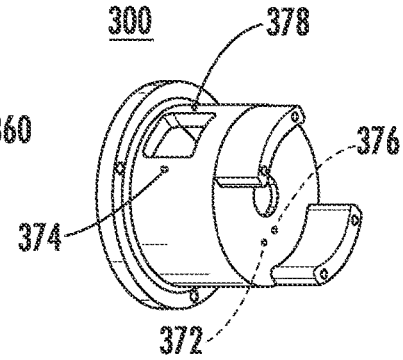
Figure 20:
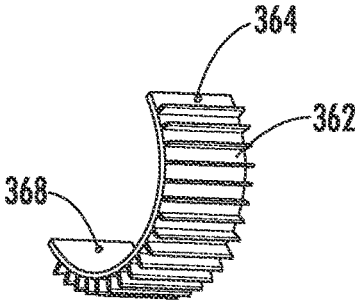

FIGS. 18-20 show the heat-sink sleeves 360 and 362. The heat-sink sleeves 360 and 362 are attached on and to the adaptor 300. Heat-sink 360 is bolted to left side of the adaptor 300 to surface of 302. Heat-sink 362 is bolted to left side of the adaptor 300 to surface of 302. Heat-sink sleeves 360 and 362 have two holes in each 6 mm of 366, 364 368 and 370. The adaptor 300 has in complementary four threaded holes 372, 374, 376 and 378 which receives the heat-sink sleeves 360 and 362 at 5 mm thread diameter in the adaptor 300 on surface of 302. The heat-sink sleeves 360 and 362 are bolted to the adaptor 300 in the assembled condition of the unit 10.

Figure 21:
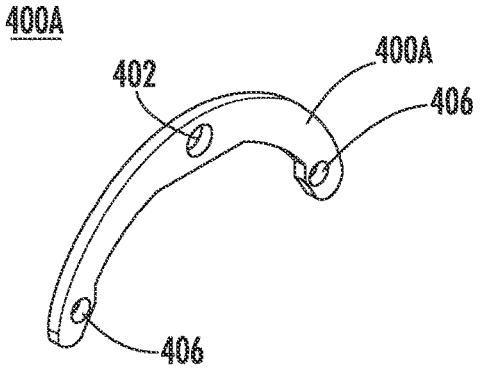
FIGS. 21-22 are a diagrammatic isometric views of the (upper and lower) two-part retaining bracket of the DC air conditioning compressor drive unit of FIGS. 1-7.
Figure 22:
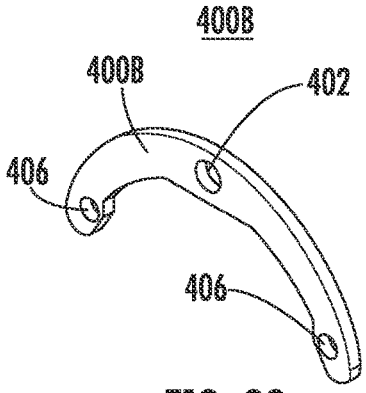
Figure 23:
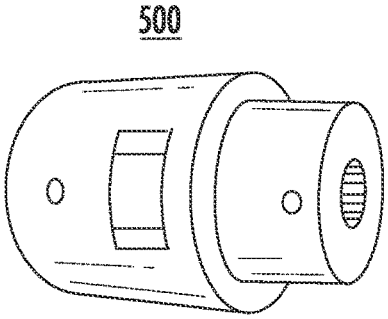
FIG. 23 is a perspective view of the coupling of the DC air conditioning compressor drive unit of FIGS. 1-7.

FIGS. 21-22 show end views of the retaining brackets 400A & 400B. The retaining brackets 400A & 400B is dimensioned to be slid over the compressor 200. The retaining brackets 400A & 400B has three (3) holes on each bracket. Holes 402 which are complementary to the threaded holes in the two mounting lugs 210 and 212 of the compressor 200. The retaining brackets 400A & 400B is thus bolted to the compressor 200 in the assembled condition of the unit 10. The retaining brackets 400A & 400B has four (4) holes 406 which are complementary to the threaded holes 318 in the two mount formations 310 of the adaptor 300. The retaining brackets 400A & 400B is thus also bolted to the adaptor 300 in the assembled condition of the unit 10.

Figure 24:
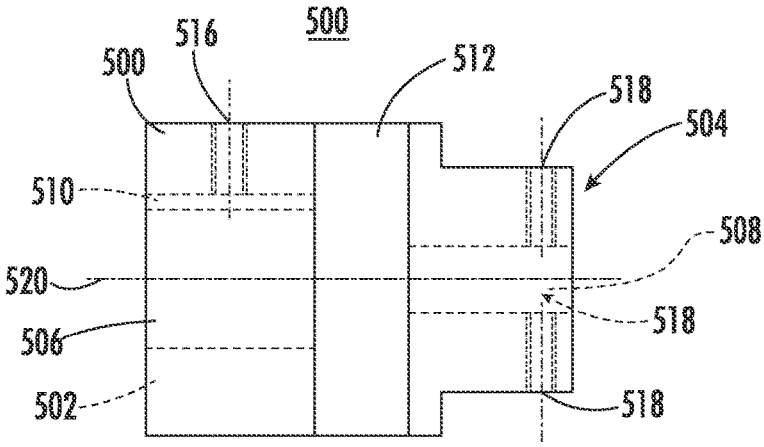
FIG. 24 is a diagrammatic side view of the coupling of the DC air conditioning compressor drive unit of FIGS. 1-7.
Figure 25:
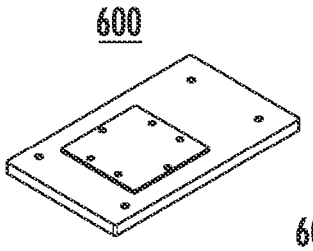
FIG. 25 is a perspective view of the base plate of the DC air conditioning compressor drive unit of FIGS. 1-7.

FIG. 24 shows a side view of the coupling 500. The coupling 500 has an electric motor end 502 and a compressor end 504. The coupling includes a drive shaft passage 506 which is open to the electric motor end 502 and a driven shaft passage 508 which is open to the compressor end 504. The passage 506, 508 are generally cylindrical. The drive shaft passage 506 is dimensioned to receive the drive shaft 102 of the electric motor 100. The drive shaft passage 506 has a keyway 510 in which the key 112 of the drive shaft 102 is received in the assembled condition of the unit 10. The driven shaft passage 508 is dimensioned to receive the driven shaft 202 of the compressor 200. The passage 506, 508 are aligned and co-axial about a rotational axis 520. The coupling 500 has threaded grub screws holes 516 and 518 that extend into the passage 506 and 508, respectively. The grub screws holes 516 are transverse to the rotational axis 520. Grub screw 516 are arranged about the drive shaft passage 506. Three (3) grub screw holes 518 are arranged about the driven passage 508. Grub screws (not shown) are screwed into the grub screw holes 516, 518 to about the drive shaft 102 and the driven shaft 202 in the assembled condition of the unit 10 to friction lock the shafts 102, 202 in the passages 506, 508.

Between the passages 506, 508 is an elastomeric disc 512. The elastomeric disc 512 dampens vibration between the drive shaft 102 of the electric motor 100 and the electric motor 100 and the driven shaft 202 of the compressor, respectively. The coupling 500 connects the electric motor 100 to the compressor 200 so that the electric motor 100 can drive the compressor 200.

Figure 26:
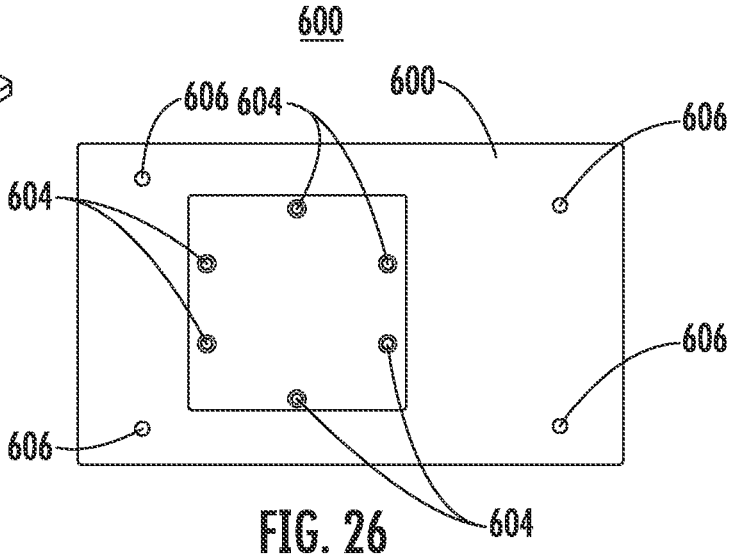
FIG. 26 is a diagrammatic top view of the base plate of the DC air conditioning compressor drive unit of FIGS. 1-7.

FIG. 26 shows a top view of the base plate 600. The base plate 600 has a raised platform 602 on which the electric motor 100 is supported. Counter-sunk holes 604 are drilled in the platform 602 for receiving bolts. The holes 604 are complementary to the threaded holes 114 (shown in FIG. 7) in the underside of the electric motor 100. In the assembled condition of the unit 10 the electric motor is bolted to the platform 602 by bolts which are received in the counter-sunk holes 604. The base plate 600 also has holes 606 in the corners thereof for bolting the base plate 600 to a substrate.

Figure 27:
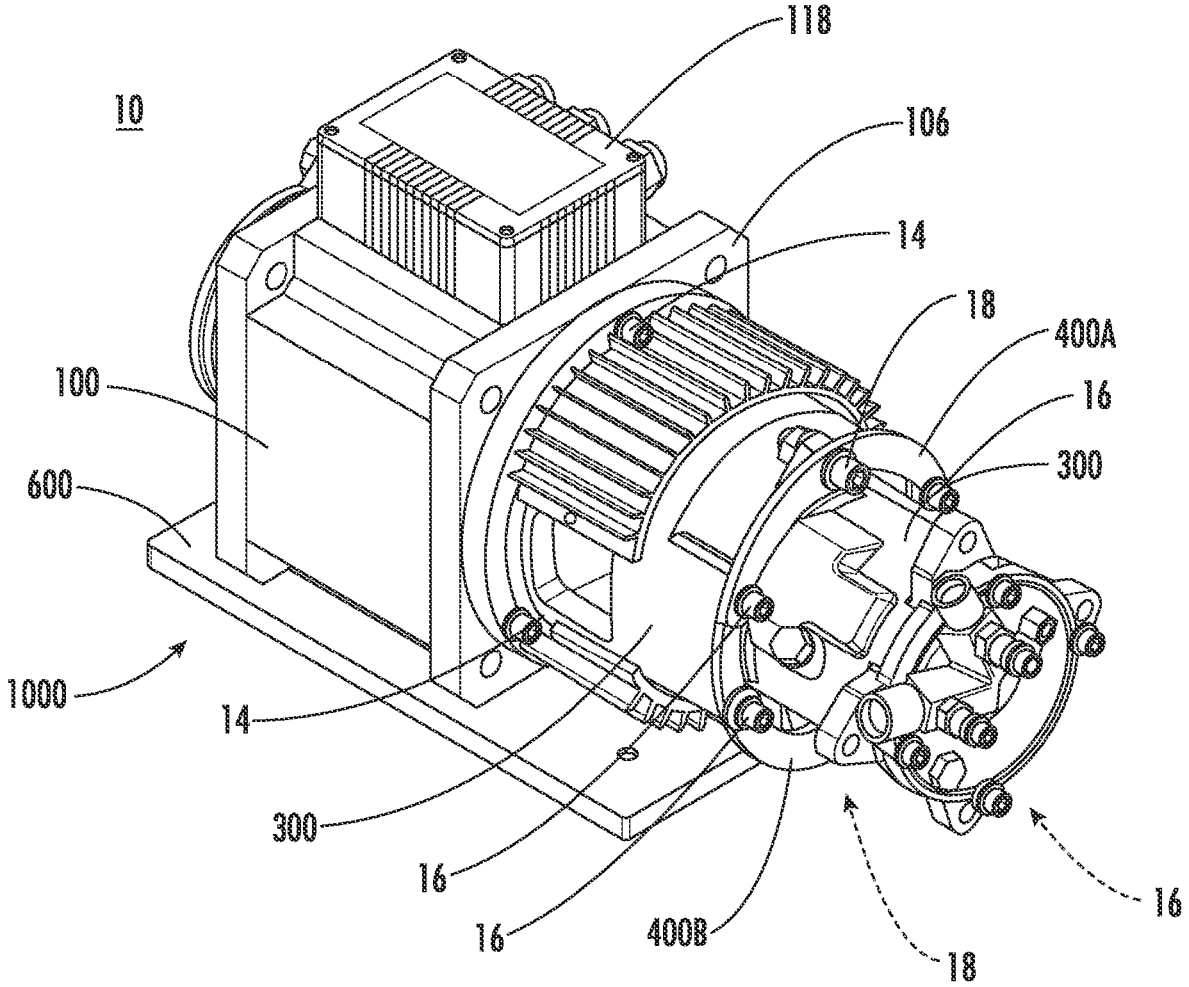
FIG. 27 is a diagrammatic perspective view of the DC air conditioning compressor drive unit of FIGS. 1-7.

FIG. 27 shows the unit 10 assembled, including bolts which bolt components of the unit 10 together. The compressor 200 is mounted relative to the electric motor 100 by the adaptor 300. The coupling 500 connects the drive shaft of the electric motor 100 with the driven shaft of the compressor 200 so that the electric motor 100 drives the compressor 200 directly.

The adaptor 300 is designed and configured so that the drive shaft 102 of the electric motor 100 and the driven shaft 202 of the main compressor 200 and substantially co-axially aligned along a rotational axis 12 (shown in FIG. 7) of the unit 10.

A mounting system 1000 of the unit 10 comprises the adaptor 300, retaining brackets 400A and 400B, base plate 600. The mounting system also includes fasteners such as bolts 14, 16 and 18. The adaptor 300 is bolted to the face plate 106 of the electric motor 100 by bolts 14. The retaining brackets 400A and 400B are bolted to the adaptor 300 by bolts 16. The compressor 300 is in turn bolted to the retaining brackets 400A and 400B by bolts 18. The electric motor 100 is bolted to the base plate 600.

Figure 28:
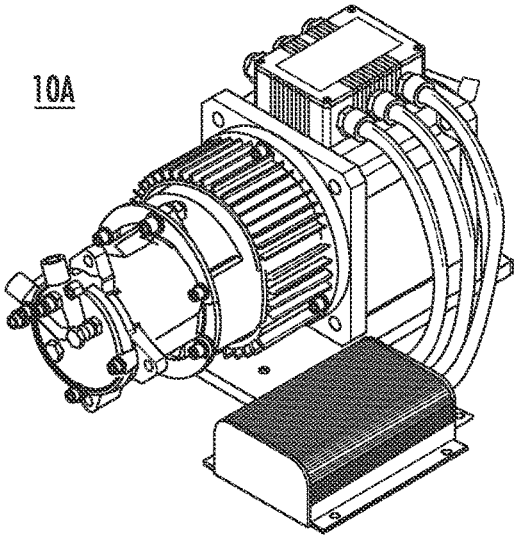
FIGS. 28-29 are is diagrammatic perspective views of the DC air conditioning compressor drive unit with the controller of FIGS. 1-7.
Figure 29:
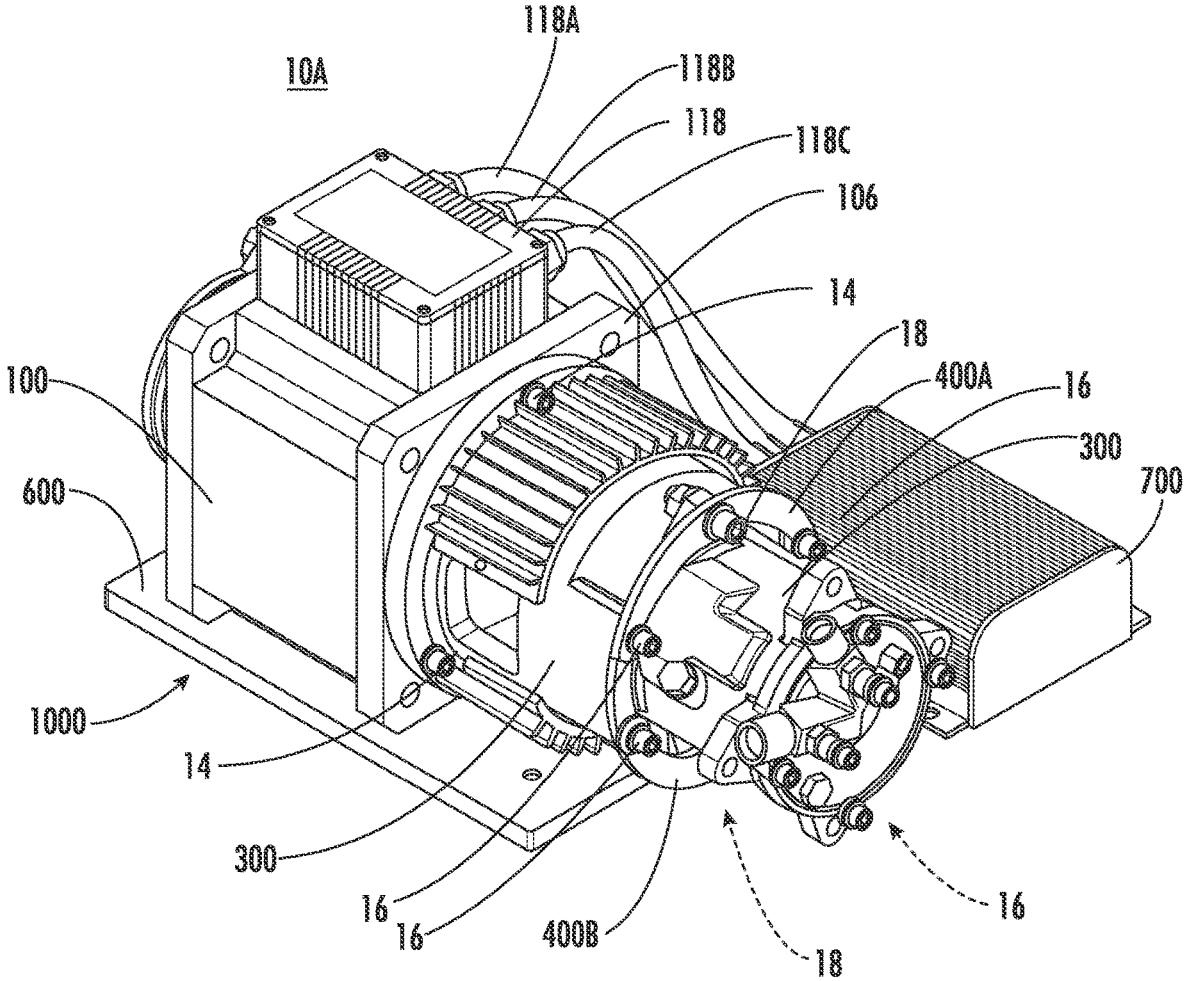

FIGS. 28-29 show the unit 10A with the controller 700 (BLDC) cabled to the electric motor 100. The controller 700 is shown with three phase wires from the electric motor 100 to the controller 700 to enter the terminal block 118. Each phase cable 118A, 118B and 118C is of different input and colour to the terminal block 118 from the controller 700.

Figure 30:
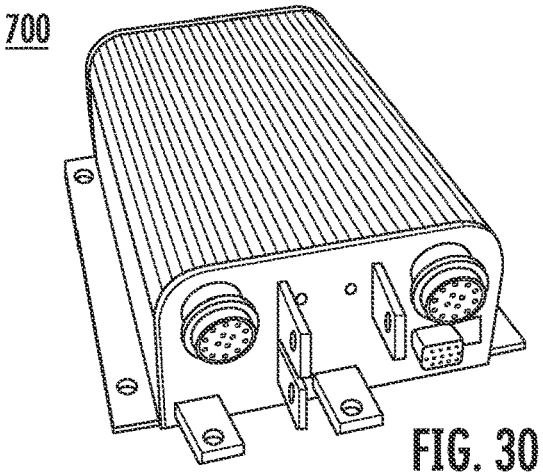
FIG. 30 is a perspective view of the controller for the DC air conditioning compressor drive unit of FIGS. 1-7.
Figure 31:
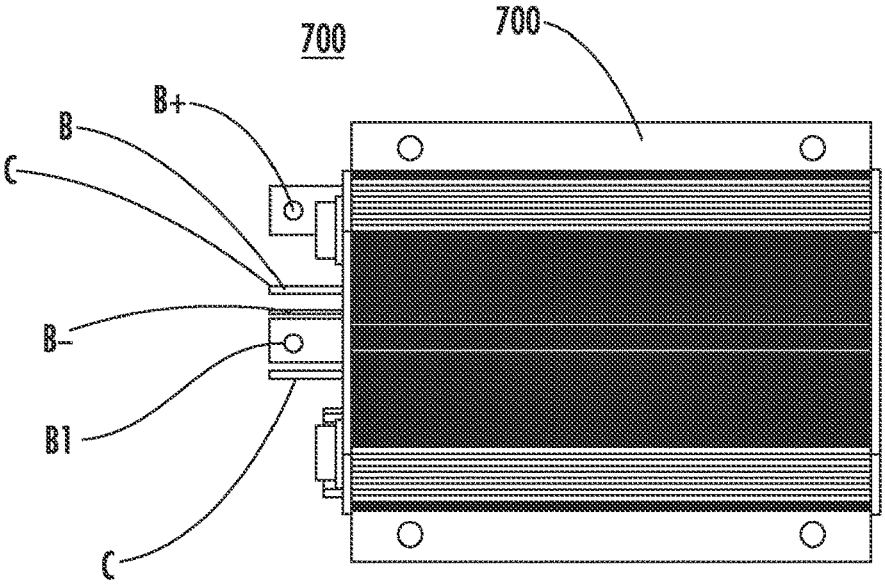
FIG. 31 is a diagrammatic top view of the controller for the DC air conditioning compressor drive unit of FIGS. 1-7.
Figure 32:
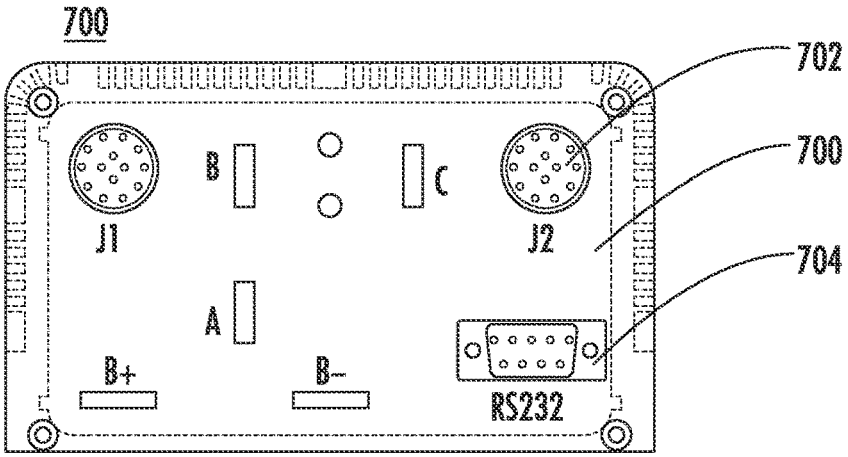
FIG. 32 is a diagrammatic front view of the front panel of the controller of FIGS. 30-31.

FIGS. 30-32 show a programmable controller 700 for the unit 10. The controller 700 receives current with an operating voltage from a battery or other DC electricity source of the electric system the 10 is to be connected to. The controller 700 is specifically selected for 12V, 24V, 48V, 72V DC electric systems but not restricted to these voltages. For a 12 volt system, a controller 700 is selected which is adapted to receive an operating voltage of between 10.5 and 15V. Similarly, for a 24V electric system a controller 700 is selected which is adapted to receive a current with an operating voltage of between 21V and 29.5V. For a 48V electric system a controller 700 is selected which is adapted to receive between 42V and 54V, and for a 72V electric system the controller 700 is selected to operate off 72V to 76V, but nor restricted to 76 volt. The controller 700 has two lugs B+ and B− for connecting to the battery or other DC electricity source of the electric system. The controller 700 has three lugs A, B, C which connect to the electric motor 100 via electric cables (as shown in FIGS. 28-29). The lugs A, B, C are each for a different phase of the electric motor 100. The controller 700 controls the voltage and the current to the electric motor 100. The voltage to the electric motor 100 is generally about the same as the operating voltage to the controller 700.

Socket 702 of the controller 700 has pins for receiving switching power to power the controller 700. The socket 702 also includes pins for receiving thermostat inputs. The controller 700 selectively powers the electric motor 100 depending on the thermostat inputs. The controller 700 includes configurable software having logic to start or stop the electric motor 100 depending on the thermostat inputs. The controller also has a pin connected via a wire to an encoder of the electric motor 100. The encoder determines the position of the rotor of the electric motor 100 and provides the rotor position as an input to the controller via the socket 702.

Connector 704 of the controller 700 is a RS232 connector via to which the controller can interface with a computer to configure the software of the controller 700.

The unit 10/A of present invention is particular efficient due to its selection of components and direct drive coupling between the electric motor 100 and the compressor 200. The brushless electric motor 100 is particularly efficient as discussed, and so is the piston type compressor 300. There is very little energy lost between the electric motor 100 and the compressor 200 due to the direct drive between these components. Direct drive is facilitated by the mounting system of the unit 10/10A, which mounts the electric motor 100 relative to the compressor 200. The mounting system also provides for the compact design of the unit 10/10A.

Particularly, the unit according to the present invention utilizes one motor, one compressor, one configuration. The unit is more versatile and enables manipulation of power.

The brushless motor (100) has a 92% efficiency from power entering the motor and only a loss of 8% from the input energy. The magnet quality is critical to the efficiency of the motor (100) as well as the calculated copper windings in the main rotor. The calculated segments are also critical to the electric motors efficiency.

The electric motor (100) has an Encoder (116) which is a solid state electronic plate with a ring magnet on the main shaft of the electric motor. The encoder reads the motor shaft position and speed and sends it to the BLDC controller (700). The BLDC controller (700) can then sense the speed, torque and current voltage/amps used to determine the correct amount of output power to be provided to the electric motor. The encoder is able to be manually adjusted under NO LOAD to get the settings correct. This will minimise energy loss, and the encoder will act as an adjustment tuner when being dialled manually (advanced or re-tarted). The encoder works from 3 points (Hall effect) and this allows the system to be fine-tuned to avoid unnecessary energy losses.

The BLDC controller (700) is chosen to suit the application of use with the current controller able to be programmed to suit the application. This programming can enable the system to fine tune its required energy in order to keep the electric motor stable with set speeds, torques, start-up in-current rush current, throttle/torque sensitive, voltage cut-outs, over-voltage, over-heat. The controller will sense more power needed to maintain the current set programmed speed and torque and will adjust accordingly.

The electric motor (100) and controller can enable the system to be interchanged with variable displacements compressors connecting to the same adaptor housing. With this configuration the best combination of compressor, speed and torque is able to be assessed to suit the application. This way the compressors electric drive is matched to the systems configuration, it enables us to change the parameters of the unit so we achieve minimal loss for the compression of the gas through the compressor.

The alloy adaptor housing (300) and heat-sink collars (360-362) with the BLDC controller (700) heat-sink play an important role in lowering the energy consumption of the full assembly. Option of brushless cooling fan is used in extreme conditions to keep the electric motor (100) and BLDC controller (700) stable with good efficiency.

The alloy adaptor housing (300) is secured by 3 bolts in the the front face plate (106) thread hole numbers (110). These are insert threads (double side thread nut-re-coil tapper M8). This helps stop heat transfer from the electric motor (100) spreading through to the alloy housing (300) and other areas. The use of alloy and the 3 bolt system are unique and integral to the invention and its efficiency in operation.

The drive coupling (500) is constructed from alloy, this is to also help with heat displacement The compressor (200) is constructed from alloy for better heat displacement than cast iron. This is standard from the compressor manufacture. Lugs are removed and front housing is modified to suit the alloy housing (300) and the coupling (500) alignment.

Throughout thus specification the aim has been to describe the invention without limiting the invention to any one embodiment of specific collection of features. Persons skilled in the relevant art may realise variations from the specific embodiments that will nonetheless falls within the scope of the invention.

The invention claimed is:

1. A direct current (DC) air conditioning compressor drive unit, comprising:

a DC electric motor having a drive shaft;

a compressor having a driven shaft;

a heat sink connection housing mounting the compressor relative to the DC electric motor and aligning the drive shaft of the DC electric motor and the driven shaft of the compressor; and a coupling connecting the drive shaft of the DC electric motor to the driven shaft of the compressor, wherein:

the DC electric motor and the heat sink connection housing enable connecting different compressors having different displacements to the heat sink connection housing and the DC electric motor;

the DC electric motor is a brushless DC motor; and the heat sink connection housing further comprises:

a heat sink sleeve attached to an outer diameter of the heat sink connection housing and bolted to the heat sink connection housing; and two arc-shaped extension portions extending from a cylindrical body portion of the heat sink connection housing and configured to mount the heat sink connection housing to the compressor.

2. The direct current air conditioning compressor drive unit according to claim 1, further including a programmable controller configured to control a supply voltage and current supplied to the DC electric motor.

3. The direct current air conditioning compressor drive unit according to claim 1, further including two retaining brackets configured to mount the compressor to the heat sink connection housing.

4. The direct current air conditioning compressor drive unit according to claim 1, wherein the compressor has a piston-type configuration.

5. The direct current air conditioning compressor drive unit according to claim 1, wherein the DC electric motor is configured to drive the compressor at a speed from and between one revolution per minute to 3000 revolutions per minute.

6. The direct current air conditioning compressor drive unit according to claim 1, further including an encoder configured to:

identify a drive shaft position of the DC electric motor;

sense a speed of the DC electric motor; and send information describing the motor shaft position and the speed of the DC electric motor to a brushless direct current controller.

7. The direct current air conditioning compressor drive unit according to claim 1, further including a three-point terminal head enclosure located on the DC electric motor.

8. The direct current air conditioning compressor drive unit according to claim 1, wherein the direct current air conditioning compressor drive unit is sealed from water and dust.

9. The direct current air conditioning compressor drive unit according to claim 1, wherein the compressor has a capacity of and between 45 cc to 120 cc.

10. The direct current air conditioning compressor drive unit according to claim 1, wherein the coupling defines two aligned passages that are each open to a different opposite end of the coupling and that are dimensioned to receive the drive shaft of the DC electric motor and the driven shaft of the compressor, respectively.

11. The direct current air conditioning compressor drive unit according to claim 10, wherein the coupling further includes an elastomeric component between the two aligned passages.

12. The direct current air conditioning compressor drive unit according to claim 1, wherein the heat sink connection housing further includes one or more of:

the cylindrical body portion defining a cavity into which the drive shaft of the DC electric motor and the driven shaft of the compressor project and in which the coupling is located;

a flange defining bolt holes for bolting the heat sink connection housing to the DC electric motor;

a first heat sink attached to an outer diameter of the cylindrical body portion; or a second heat sink attached via bolts and a heat-sink pad cloth between the second heat sink and the cylindrical body portion.

13. The direct current air conditioning compressor drive unit according to claim 1, wherein:

a flange of the heat sink connection housing defines three holes therein;

the brushless DC electric motor comprises a faceplate defining three threaded holes; and the brushless DC electric motor is fastened to the heat sink connection housing by three bolts fastened to the three threaded holes defined by the faceplate via the three holes defined by the flange.

14. The direct current air conditioning compressor drive unit according to claim 1, wherein the coupling is configured to dissipate heat.

15. The direct current air conditioning compressor drive unit according to claim 1, wherein the heat sink sleeve has a partial-radius shape.

* * * * *